US007399104B2

(12) United States Patent
Rappaport

(10) Patent No.: US 7,399,104 B2
(45) Date of Patent: Jul. 15, 2008

(54) UNIVERSAL TRIM FOR RECESSED LIGHTING

(75) Inventor: Margaret Rappaport, c/o Maggie Rose Design Ltd., P.O. Box 1925, 8 Old Point Rd., Quogue, NY (US) 11959

(73) Assignee: Margaret Rappaport, Quogue, NY (US)

( * ) Notice: Subject to any disclaimer, the term of this patent is extended or adjusted under 35 U.S.C. 154(b) by 95 days.

(21) Appl. No.: 10/857,768

(22) Filed: May 28, 2004

(65) Prior Publication Data

US 2005/0265016 A1 Dec. 1, 2005

(51) Int. Cl.
*F21V 17/00* (2006.01)

(52) U.S. Cl. ..... 362/365; 364/364; 364/396; 364/147

(58) Field of Classification Search ..... 362/364, 362/365, 147, 148, 398, 396
See application file for complete search history.

(56) References Cited

U.S. PATENT DOCUMENTS 3,518,420 A * 6/1970 Kripp ..... 362/257
3,697,742 A 10/1972 Bobrick
4,117,887 A 10/1978 Anderson
4,872,512 A 10/1989 Multer
5,309,342 A 5/1994 Heinen, Sr.
5,465,199 A 11/1995 Bray et al.
5,548,499 A * 8/1996 Zadeh ..... 362/366
5,588,737 A * 12/1996 Kusmer ..... 362/148
5,820,247 A * 10/1998 Schuler ..... 362/96
5,909,955 A 6/1999 Roorda
5,921,655 A * 7/1999 Nassim ..... 362/147
6,116,758 A * 9/2000 Lin ..... 362/364
6,350,046 B1 * 2/2002 Lau ..... 362/364
6,364,511 B1 4/2002 Cohen
6,457,848 B1 10/2002 Wolf et al.
6,474,846 B1 * 11/2002 Kelmelis et al. ..... 362/365
6,543,915 B1 4/2003 Chen
6,595,664 B2 * 7/2003 Bucher et al. ..... 362/404
6,623,138 B1 * 9/2003 Hsu ..... 362/147
6,957,896 B2 * 10/2005 Burgess ..... 362/147

* cited by examiner

*Primary Examiner*—Jacob Y Choi
(74) *Attorney, Agent, or Firm*—Joseph A. Fuchs; Rockey, Depke & Lyons, LLC

(57) ABSTRACT

A universal trim piece for a recessed light includes a mounting side disposed toward a ceiling and having an aperture sized to conform with a dimension of an open side of a housing for a recessed light. A decorative side is disposed opposite the mounting side and a universal engagement member, disposed on the mounting side, removably engages a trim ring on the recessed light and secure the universal trim piece to the housing and proximate to the ceiling.

8 Claims, 8 Drawing Sheets

FIG. 3A
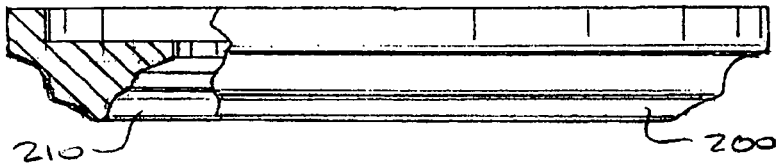
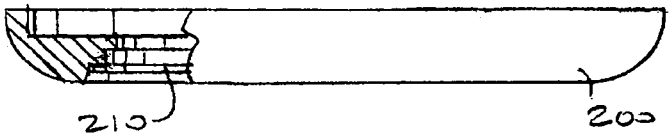
FIG. 3B
FIG. 3C
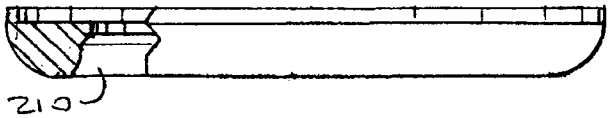
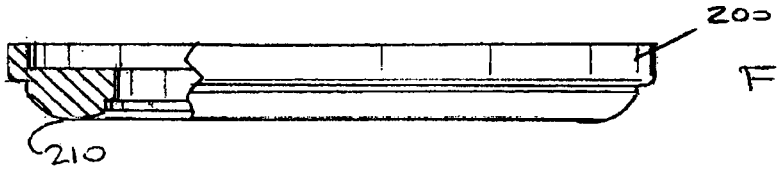
FIG. 3D
FIG. 4A
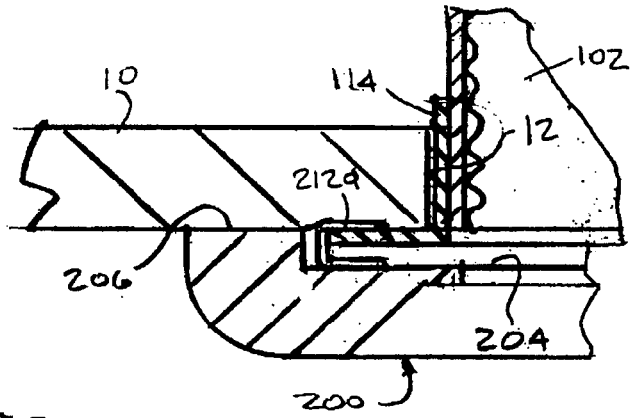
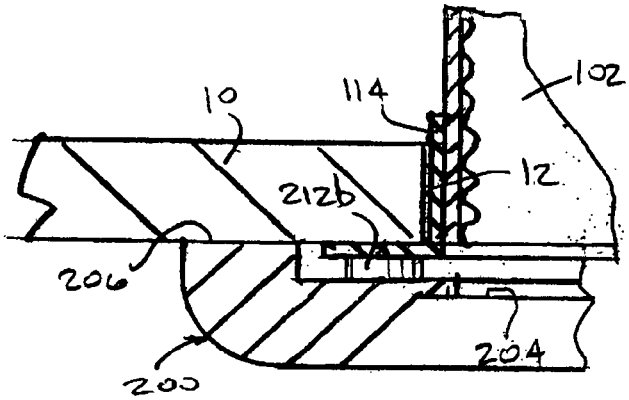
FIG. 4B FIG. 9
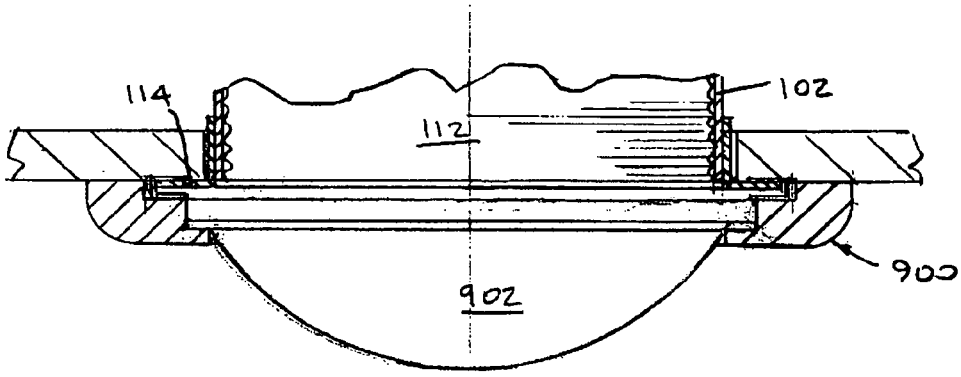
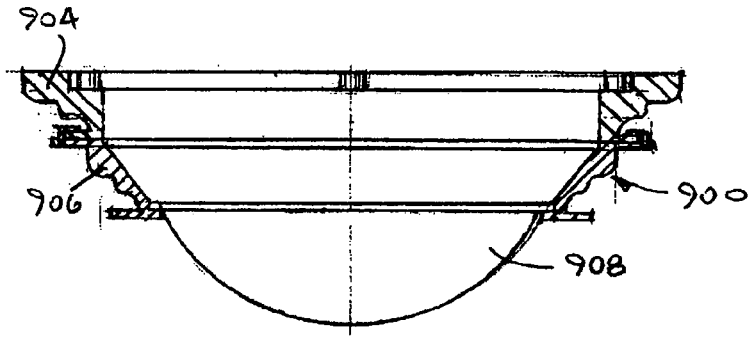
FIG. 10
FIG. 11b
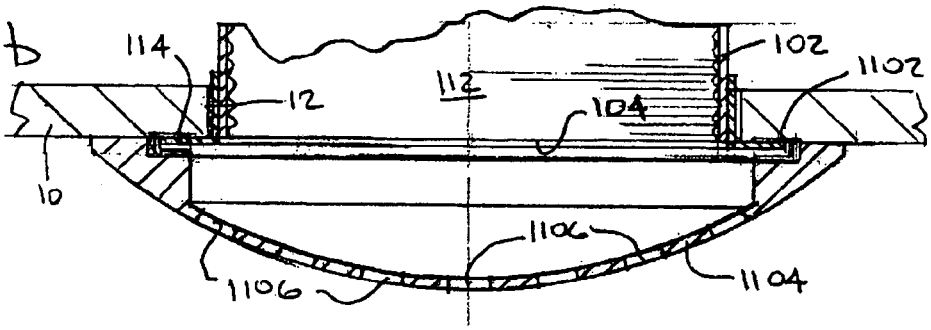
FIG 11c
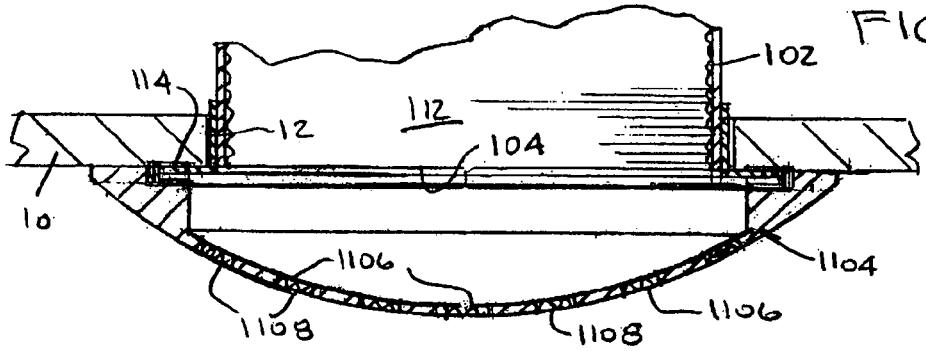

UNIVERSAL TRIM FOR RECESSED LIGHTING

BACKGROUND OF THE INVENTION

1. Field of the Invention

The invention relates to electric lighting fixtures, particularly recessed lighting, down light fixtures, and flush mounted fixtures and a designer trim ring that mounts to the exterior of the light fixture regardless of the manufacturer of the fixture.

2. Description of the Related Art

Recessed lights and flush mounted fixtures are standard lighting fixtures in most homes and commercial establishments. Recessed lights are mounted inside of a ceiling and a hole is cut in the ceiling to let the light shine through. A trim ring is used to cover the cut edge of the ceiling and typically lays flush with the ceiling.

Recessed lights are manufactured by many companies, and although most recessed lights seem universal, they are not. There are variations of the size, shape, trim rings, baffles and the means by which the trim rings and baffles engage the housing which is located inside the ceiling. Thus, baffles and trim rings from one manufacturer do not fit on the housing of another manufacturer. This poses a problem for most users who want to change the look of their recessed lights once the light is installed. The recessed light installed may not have the new style the user is looking for and the manufacturer may be out of business or does not carry the user's line of recessed light so a user can either get replacement parts or upgrades. Further, recessed lights are expensive and difficult to replace, typically requiring the ceiling to be torn open to reach the housing.

U.S. Pat. No. 6,116,758 to Lin discloses a removable trim piece. FIG. 2 of Lin shows external cover 7, decoration cover parts 8 and projecting end 22. Lin discloses that the external cover 7 "lock-blocks" on the projecting end 22 and different types of external cover can be used as designs require. Further, Lin discloses, in FIGS. 9-14, numerous decoration cover parts 8. However, Lin's projecting end 22 is integral with lamp shell 2. Thus, Lin's external cover 7 is not universal to any recessed light, but only fits Lin's lam shell 2. Thus, a user will experience the same difficulties as above because the user is forced to use Lin's product. Additionally, a user who did not install Lin's lamp shell cannot use external cover 7.

U.S. Pat. No. 6,457,848 to Wolf et al. ("Wolf") discloses, in FIG. 1, decorative trim member 90 engaging flange 45 and the engagement can be by a bayonet-type lock or alternate ways. As with Lin, Wolf's flange 45 is integral with can 30 and trim member 90 can only engage Wolf's can and is thus not universal. As an example, Lin's external cover 7 cannot be used with Wolf's flange 45 nor can Wolf's trim member 90 engage Lin's projecting end 22. Thus, although Lin and Wolf disclose trim pieces that are removable, they do not disclose trim pieces that are universal to any recessed light.

Another reference, U.S. Pat. No. 3,518,420 to Kripp discloses a baffle 48 held in place by a ring 36 once inserted in to the can. The can is formed by a mounting ring 21 and a bracket 27. Baffle 48 rests on an up-turned section 50 of ring 36 and between arms 39. Arms 39 of ring 36 are provided with serrations 41 and are inserted into narrow slots 43. Ring 36 is held in place by serrations 41 engaging dimples 42 located on mounting ring 21. Kripp discloses a very specialized recessed light. Kripp's baffle cannot be retrofitted onto an existing recessed light because rests solely on ring 36 and cannot support its own weight. Ring 36 is not a standard feature of most recessed light on the market at the time of the invention and is not designed to fit any recessed light housing regardless of size and manufacturer.

Additionally, U.S. Pat. No. 6,364,511 to Cohen discloses a universal adapter bracket 36 for a recessed light. Universal bracket 36 is designed to accommodate different types of lamp socket clips for retrofitting of ornamental trim assemblies in existing in-ceiling light fixture installations. Baffle 32 is attached to universal bracket 36 via screws and then baffle 32 and bracket 36 are attached to a housing 12 via springs 38 set inside corresponding bracket 40. Cohen's universal adapter bracket 36 is a specialized adaptor in that requires corresponding bracket 40, mounted inside the can, to function properly. Universal adaptor bracket 36 cannot adapt to any recessed light without the extra effort required to mount corresponding bracket 40.

Thus, there is a need in the art for a universal trim piece that can retrofit onto any recessed light with minimal effort and/or modification of the existing fixture.

SUMMARY OF THE INVENTION

A universal trim piece has an aperture sized to approximately conform to a dimension of an open side of a housing of a recessed light. The aperture generally conforms to a circular opening on the open side. However, in an embodiment, both the universal trim piece and the aperture can be any shape, including circular, elliptical, oval, triangular, rectangular, or any curved or polygonal shape. Further, both the universal trim piece and aperture can be similarly shaped, e.g. both circular, or can have different shapes, e.g. universal trim piece is circular and aperture is rectangular. The universal trim piece can be manufactured out of any material known in the art, including aluminum, steel, brass, nickel, chrome, pewter, copper, gold (leaf), silver (leaf), and plastic. All of the materials can also undergo further finishing treatments to alter the appearance of the material, for example, polishing, brushing and antiquing.

Further embodiments of the universal trim piece include that the universal trim piece can be manufactured of one material and coated, covered, or plated with a second material, e.g., gold plating. Additionally, multiple trim pieces, manufactured of different metals or the same metal with different finishes can be fitted one on top of the other to form the universal trim piece.

A mounting side is disposed toward a ceiling and is typically a flat surface so the mounting side can contact the ceiling. In a preferred embodiment, the universal trim piece further includes an upstanding lip disposed on a perimeter of the mounting side. The lip allows for a gap between trim ring and mounting side. When the lip is included, it preferably contacts the ceiling. Further embodiments may variably contact the ceiling due to the visual style of the universal trim piece or as a consequence of the process that forms the universal trim piece, e.g. stamping and casting.

The universal trim piece has a decorative side disposed opposite the mounting side, which is viewable when one looks up at the ceiling, and is milled with a pattern, shape and/or texture to provide an aesthetic look once the universal trim piece is mounted to the trim ring.

A universal engagement member can be disposed on the mounting side to removably engage the trim ring. One or more universal engagement members allow universal trim piece to retrofit onto any existing recessed lighting fixture, regardless of manufacturer. Housings and trim rings, regardless of manufacturer, are sold in a number of standard size ranges. The universal trim piece is designed to fit a range of similar sized recessed lights and universal engagement member is disposed to engage a range of sizes of trim rings. More particularly, engagement members are arranged to engage a small, intermediate, and large sized trim rings.

The universal engagement member removable engages the trim ring to allow a user to change or remove the universal trim piece with minimal effort and does not require the housing to be removed from the ceiling and replaced. In a preferred embodiment, the universal engagement member only engages the trim ring and does not engage the housing.

Numerous types of universal engagement members are contemplated, including a leaf tab made of a strong, malleable material, e.g. spring steel, and designed to bend around the trim ring and, once bent, remain in place to engage the universal trim piece to the trim ring. These act similar to a clamp and other clamp embodiments known to those of skill in the art are also considered. Further, a magnet can engage the trim ring and can only be used when the trim ring is made of a magnetic or magnetically susceptible material.

An adhesive can engage trim ring and can be a single part or multipart epoxy and can be easily dissolved with a solvent or designed to be removed (for example Command™ Adhesive, by 3M). A further embodiment of the adhesive can permanently affix the universal trim piece to the trim ring.

A fastener can be used and can be a nail, screw or other mechanical fastener that can penetrate through the trim ring to secure the universal trim piece. Also, hook and eye fasteners (i.e. Velcro™) can also be used, where one side is affixed to the trim ring and the other side is affixed to the mounting side.

Compression members can engage an edge of the trim ring. The compression member can be screw mounted to engage the edge once tightened into place and frictionally engage the universal trim piece to the trim plate. Another embodiment of a compression member can spring mount an element and the spring provides the force for the frictional engagement and can be disengaged once the spring is compressed.

Spring-loaded members can used to engage the trim plate so a member can engage the trim plate and be spring loaded so that the element can be disengaged once the spring is compressed but differs from the embodiment above in that the member does not frictionally the engage trim plate.

A threaded member can engage the trim plate. A threaded ring is placed around the trim plate and the ring can be incomplete so it can be flexible to fit around the trim plate without removing it from the housing. The ring is threaded and can engage mating threads disposed on the mounting side, allowing the universal trim piece to be screwed on and off with ease. Also, suction members can engage the trim plate, e.g. suction cups, using vacuum force. Other vacuum type engagement members can be used.

A further embodiment is a universal trim insert designed to be used with any recessed light and includes a baffle and a trim piece. The baffle is sized to be disposed inside the housing, replaces the prior art baffle, and is inserted into the housing. A baffle engagement member can be disposed on the baffle and can removably engage the housing. One or more baffle engagement members can be used. In the preferred embodiment, the baffle engagement member is a leaf spring formed from spring steel and frictionally engages a side of the housing. Other baffle engagement members can be similar to the universal engagement member described above. The baffle engagement member allows the universal trim insert to retrofit onto any existing recessed lighting fixture, regardless of manufacturer.

An interface member can be disposed on an end of the baffle and located outside the ceiling. The interface member can contact the ceiling when the baffle is engaged in the housing or it can be set inside. In an embodiment, a universal trim piece engages the interface member and the engagement is described below. In another embodiment, a trim engagement member can be disposed on the interface member and interacts with an engagement member to removably engage and secure the universal trim piece.

The trim piece has an aperture sized to approximately conform to a size of the open side of the housing 102 and can be manufactured out of any of the materials described above in the previous embodiment.

A mounting side is disposed toward the ceiling and includes an upstanding lip disposed on its perimeter. The lip allows for a gap between the ceiling and the mounting side and contacts the ceiling.

A decorative side is disposed opposite the mounting side and can have the same properties and designs as above.

A universal engagement member can be disposed on the mounting side to removably engage the interface member and secure the trim piece to it. In a preferred embodiment, the universal engagement member only engages the interface member and does not engage the housing. The universal engagement member can be similar to the universal engagement members as described above.

Another embodiment mounts to a flush mounted fixture. A universal trim piece is designed to, in one embodiment, cover the trim ring. The universal trim piece has an aperture sized to receive the dome and can be larger. The aperture generally conforms to a circular shape of the dome but both the universal trim piece and the aperture can be any shape that will accept the dome. Both the universal trim piece and the aperture can be similarly or differently shaped. The universal trim piece can be manufactured out of any material known in the art, including the exemplary materials for universal trim piece, described above, and have any finish.

A universal engagement member can be disposed on a mounting side to removably engage the trim ring. One or more universal engagement members allow the universal trim piece to retrofit onto any existing flush mounted fixture cover, regardless of manufacturer. Numerous types of universal engagement members are contemplated and can be similar to the universal engagement member described above.

A universal trim piece can be made of two or more different sections. A trim engagement section can be disposed closest to the ceiling and typically a universal engagement member is disposed on this section. The universal engagement member can be similar to the ones described above.

The trim engagement section can be manufactured out of any material known in the art, including the exemplary materials for the universal trim piece, described above, and have any finish. The trim engagement section is typically circular and has an outside diameter and an inside diameter. However, in an embodiment, the trim engagement section can be any shape.

A second section is disposed below trim engagement section and a first section engagement member is disposed opposite the ceiling side of trim engagement section and engages a second section engagement member disposed on the second section.

The second section is typically circular and has an outside and inside diameter but, in an embodiment, the second section can be any shape. The materials, finishes, shapes, sizes, inside and outside diameters of the trim engagement an second sections can be similar or different. This allows a user to mix and match all aspects of the design of universal trim ring.

A third section can also be included in the universal trim piece and the second section includes a third section engagement member engaging a fourth section engagement member disposed on the third section. The third and fourth section engagement members can be any fastener described above and any fastener contemplated by one of skill in the art.

Further, the third section can be manufactured out of any material known in the art and have any finish. The third section is typically circular but can be any shape. The materials, finishes, shapes, sizes, and diameters of the trim engagement, second and third sections can be similar or different.

Another embodiment of a universal trim piece places a lens or a dome in the aperture to retro-fit the recessed light to look like a flush mounted fixture. The universal trim piece includes all the features and range of options of the above universal trim piece. Further, when the universal trim piece includes a trim engagement, second and third section, all three sections can be different in all aspects, including, e.g. sizes, shapes, and materials.

The universal trim pieces described above can include a diffuser section to fully or partially obscure the open side of the recessed light. The diffuser section can be made of a translucent material to diffuse light emitted from the lamp or it can be made from an opaque material and slits can allow light to pass. The slits can be cut into diffuser section to form a pattern or can be placed at random. Further, a transparent or translucent material can be disposed in the slits to form a diffused light pattern or a translucent material can be colored to produce different lighting effects. The diffuser section can extend past the ceiling and mimic a different type of fixture. The diffuser section can have a ceiling section which lays flush with the ceiling when the universal trim piece is mounted to the trim. The ceiling section has an aperture to allow light to enter the diffuser section and can be shaped to allow the trim piece to pass and have a universal engagement member mounted inside the diffuser section. Alternately, the aperture can be shaped to allow all or most of the light emitted thorough the open side but prevent the trim ring from entering the diffuser section and the universal engagement member can be mounted on a ceiling side of the ceiling section.

Two or more side walls can depend from the ceiling section and can be transparent, translucent, or opaque and do not have to be equally sized. Further, the side walls can contain openings cut into the side walls to form a pattern or can be placed at random. Further, a transparent or translucent material can be disposed in the openings to form a diffused light pattern or can be colored to produce different lighting effects.

Alternately, a bottom wall can be disposed to fully or partially enclose the side walls and can be the same or a different shape than the ceiling section and can have openings similar to the side walls.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIGS. 3A-3D illustrate various alternate contours for the decorative side of the universal trim piece of FIG. 1;

FIGS. 4A-4H illustrate exemplary arrangements of the universal engagement member;

FIG. 9 is a cross-sectional view of a further embodiment of the universal trim piece mounted to a recessed light;

FIG. 10 is a cross-sectional view of another embodiment of a sectioned universal trim piece mounted to a recessed light;

Figure 11A:
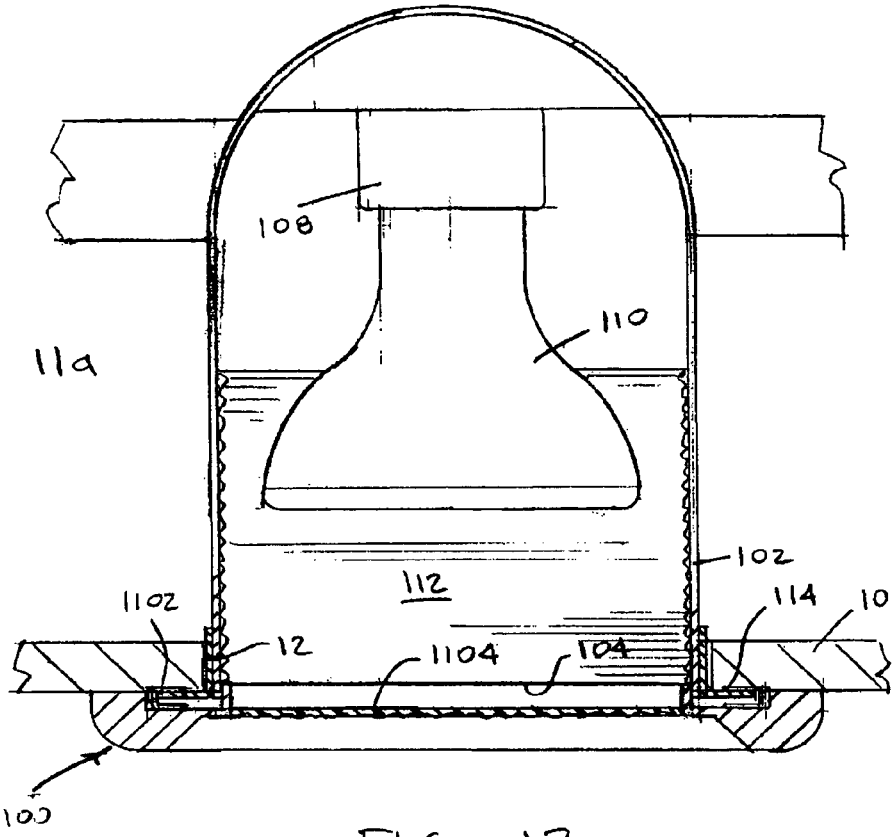
Figure 12:
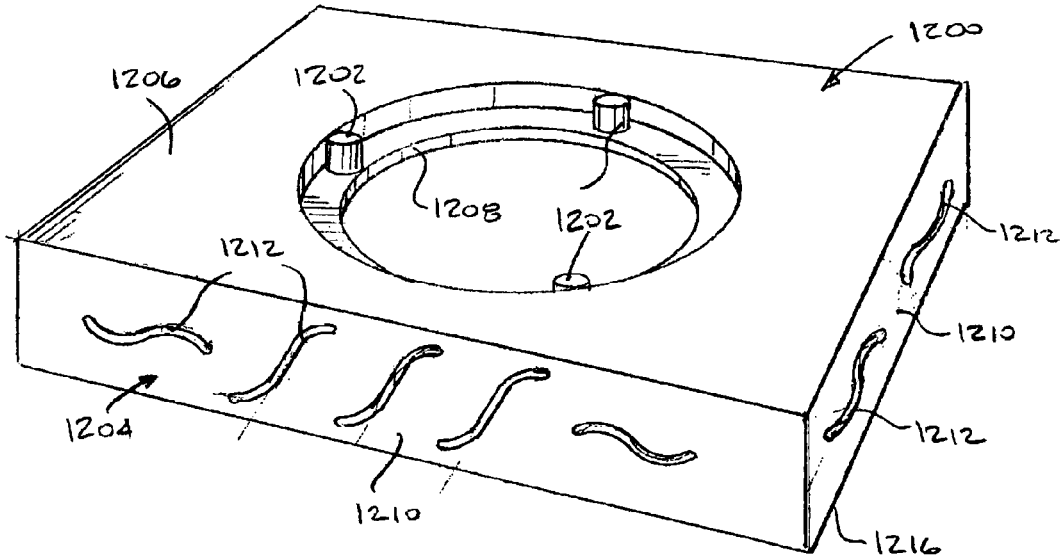

FIGS. 11*a*-11*c* are a cross-sectional views of a further embodiment of a universal trim piece of the present invention; and FIG. 12 is a perspective view of an embodiment of a universal trim piece.

DETAILED DESCRIPTION OF THE PREFERED EMBODIMENT

Figure 1:
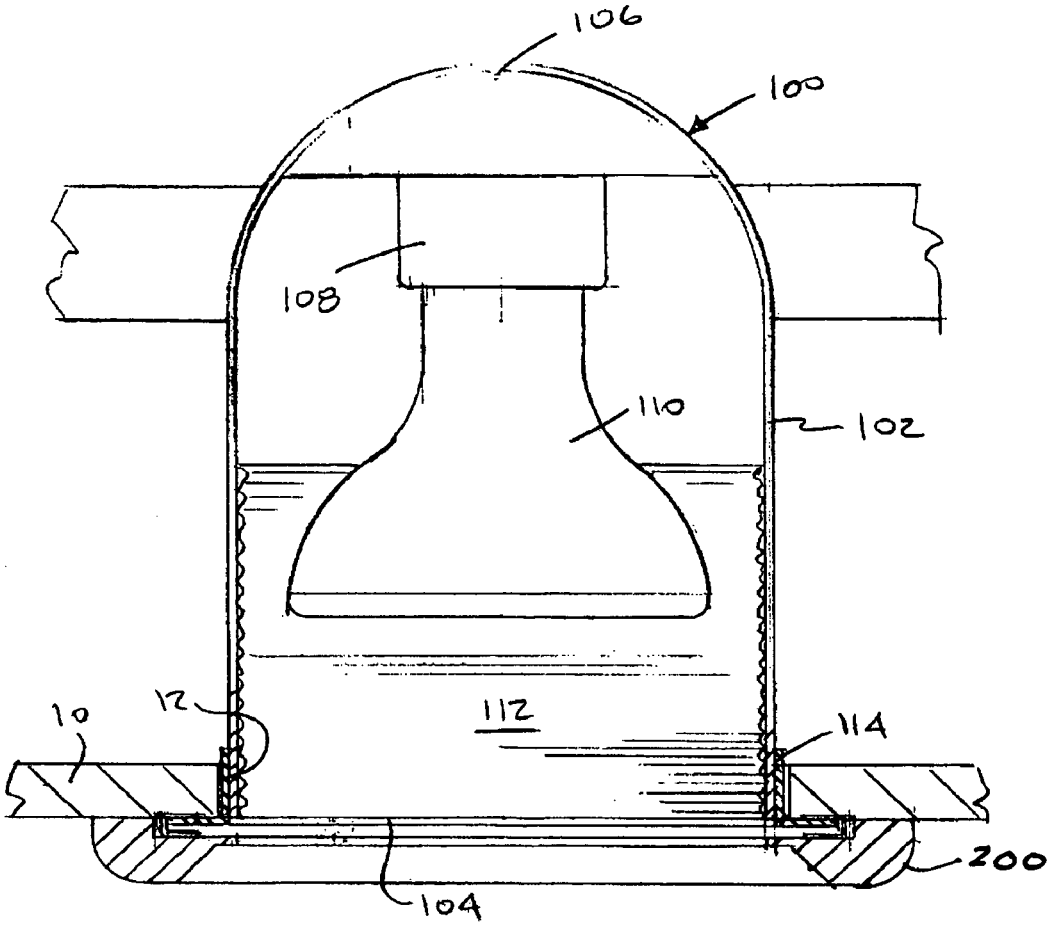
FIG. 1 is a cross sectional view of a universal trim piece according to an embodiment mounted to a recessed light.
Figure 2:
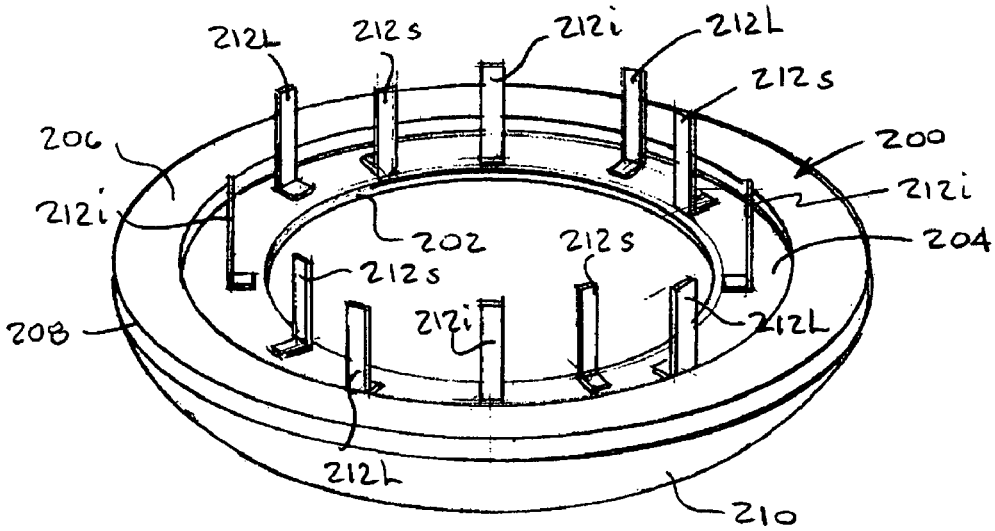
FIG. 2 is a perspective view of the universal trim piece of FIG. 1.

Referring to FIGS. 1 and 2, universal trim piece 200 for a recessed light 100, according to a preferred embodiment of the present invention, is illustrated. FIG. 1 illustrates a typical recessed light 100 including a housing 102 mounted above or within a ceiling 10 and having an open side 104 and a socket side 106. A lamp socket 108 is mounted to socket side 106, is connected to a power supply (not illustrated), and is positioned to be accessed from open side 104, e.g. to change a lamp 110. Lamp 110 engages lamp socket 108 and lamp socket 108 provides power for lamp 110. Mounted inside housing 102 can be baffle 112. Further, a trim ring 114 is mounted to open side 104 of housing 102 and upon ceiling 10. In the prior art, trim ring 114 is designed as an integrated part of housing 102 and specifically fits a specific housing 102. Trim ring 114 is designed to obscure from view an opening 12 cut through ceiling 10 yet expose open side 104 of housing 102. Note that other recessed lights and housings are known to those of skill in the art. The present invention is not limited to the recessed light described herein but can be used on all recessed, down lights, dome lights, and flush mounted lighting fixtures known and contemplated by ones of skill in the art.

Turning to the present invention, FIG. 2 illustrates a universal trim piece 200 having an aperture 202 sized to approximately conform to a dimension of open side 104 of housing 102. As illustrated, aperture 202 generally conforms to a circular opening on the open side 104. However, in an embodiment, both universal trim piece 200 and aperture 202 can be any shape, including circular, elliptical, oval, triangular, rectangular, or any curved or polygonal shape. Further, both universal trim piece 200 and aperture 202 can be similarly shaped, e.g. both circular, or can have different shapes, e.g. universal trim piece 200 is circular and aperture 202 is rectangular. Universal trim piece 200 can be manufactured out of any material known in the art, including aluminum, steel, brass, nickel, chrome, pewter, copper, gold (leaf), silver (leaf), and plastic. All of the materials can also undergo further finishing treatments to alter the appearance of the material, for example, polishing, brushing and antiquing.

Further embodiments of the universal trim piece 200 include that the universal trim piece 200 can be manufactured of one material and coated, covered, or plated with a second material, e.g., gold plating. Additionally, multiple trim pieces, manufactured of different metals or the same metal with different finishes can be fitted one on top of the other to form the universal trim piece 200.

A mounting side 204 is disposed toward ceiling 10 and is typically a flat surface so mounting side 204 can contact ceiling 10. In a preferred embodiment, universal trim piece 200 further includes an upstanding lip 206 disposed on a perimeter 208 of mounting side 204. Lip 206 allows for a gap between trim ring 114 and mounting side 204. When lip 206 is included, it preferably contacts ceiling 10. Further embodiments may variably contact ceiling 10 due to the visual style of universal trim piece 200 or as a consequence of the process that forms universal trim piece 200, e.g. stamping and casting.

Universal trim piece 200 has a decorative side 210 disposed opposite mounting side 204 which is viewable when one looks up at ceiling 10. In the preferred embodiment, decorative side 210 is milled with a pattern, shape and/or texture to provide an aesthetic look once universal trim piece 200 is mounted to trim ring 114. FIGS. 3A-3D illustrate different possible contours for decorative side 210 each of which is merely exemplary given a myriad of decorative possibilities.

A universal engagement member 212 can be disposed on mounting side 204 to removably engage trim ring 114. One or more universal engagement members 212 allow universal trim piece 200 to retrofit onto any existing recessed lighting fixture 100, regardless of manufacturer. Housings and trim rings, regardless of manufacturer, are sold in a number of standard size ranges. Universal trim piece 200 is designed to fit a range of similar sized recessed lights and universal engagement member 212 is disposed to engage a range of sizes of trim rings. More particularly, engagement members 212*i* are arranged to engage an intermediate sized trim ring whereas engagement members 212*s* engage smaller trim rings, and engagement members 212L engages larger trim rings.

Another element is that universal engagement member 212 removable engages trim ring 114. This allows a user to change or remove universal trim piece 200 with minimal effort and does not require housing 102 to be removed from ceiling 10 and replaced. Removing housing 10 requires the removal of a portion of the ceiling, the severing of the old housing from the power supply, wiring the new housing and replacing the ceiling. The above steps are time consuming and expensive. Universal trim piece 200 can be engaged and removed without altering housing 102 or ceiling 10 via universal engagement member 212. In a preferred embodiment, universal engagement member 212 only engages trim ring 114 and does not engage housing 102.

Referring to FIGS. 4A-4D, numerous types of universal engagement members 212 are illustrated. Their position relative to aperture 202 and lip 206 affect whether they engage a small, intermediate, or large trim ring (212*s*, 212*i*, 212L) The below are typical embodiments and any engagement members known to persons of ordinary skill in the art are contemplated for the invention.

FIG. 4A illustrates leaf tab 212*a*. Leaf tab 212*a* is made of a strong, malleable material, e.g. spring steel, and is designed to bend around trim ring 114 and, once bent, remain in place to engage universal trim piece 200 to trim ring 114. Leaf tab 212*a* acts similar to a clamp and other clamp embodiments known to those of skill in the art are also considered.

FIG. 4B illustrates magnet 212*b* engaging trim ring 114. This embodiment can only be used when trim ring 114 is made of a magnetic or magnetically susceptible material. The magnet need only be on one of the complementary pieces.

Figure 4C:
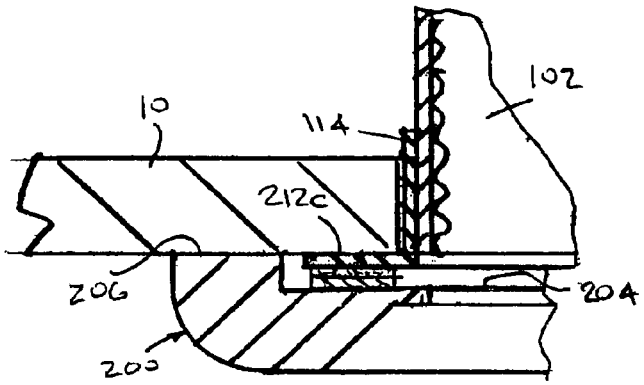

FIG. 4C illustrates adhesive 212*c* engaging trim ring 114. Adhesive 212*c* can be a single part or multipart epoxy and can be easily dissolved with a solvent or designed to be removed (for example Command™ Adhesive, by 3M). A further embodiment of adhesive 212*c* can permanently affix universal trim piece 200 to trim ring 114.

Figure 4D:
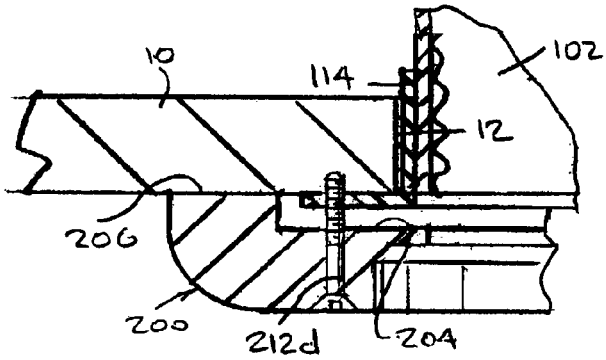

Referring to FIG. 4D, fastener 212*d* is illustrated. Fastener 212*d* can be a nail, screw or other mechanical fastener that can penetrate through trim ring 114 to secure universal trim piece 200. Also, hook and eye fasteners (i.e. Velcro™) can also be used, where one side is affixed to trim ring 114 and the other side is affixed to mounting side 204.

Figure 4E:
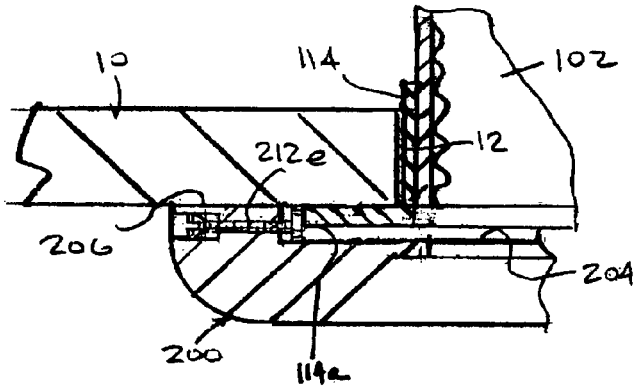

FIG. 4E illustrates compression member 212*e* engaging an edge 114*a* of trim ring 114. Compression member 212*e* can be screw mounted to engage edge 114*a* once tightened into place and frictionally engage universal trim piece 200 to trim plate 114. Another embodiment of compression member 212*e* can spring mount an element and the spring provides the force for the frictional engagement and can be disengaged once the spring is compressed.

Figure 4F:
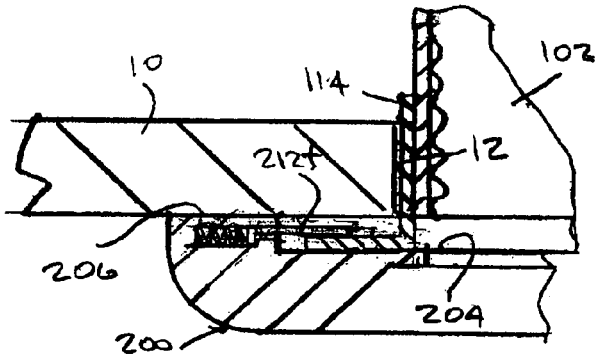

FIG. 4F illustrates a spring-loaded member 212*f* used to engage trim plate 114. A member can engage trim plate 114 and be spring loaded so that the element can be disengaged once the spring is compressed but differs from the embodiment above in that the member does not frictionally engage trim plate 114.

Figure 4G:
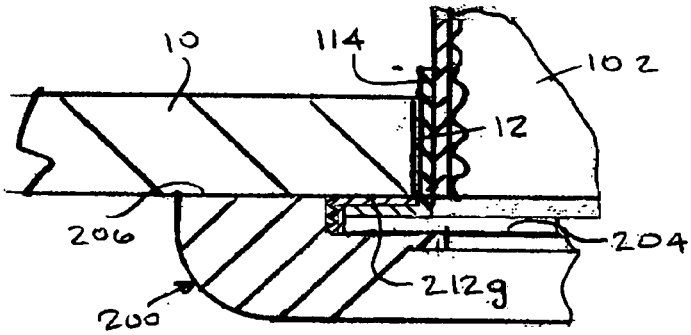

FIG. 4G illustrates a threaded member 212*g* engaging trim plate 114. Threaded ring is placed around trim plate 114. The ring can be incomplete so it can be flexible to fit around trim plate 114 without removing trim plate 114 from housing 102. The ring is threaded and can engage mating threads disposed on mounting side 204. This allows universal trim piece 200 to be screwed on and off with ease.

Figure 4H:
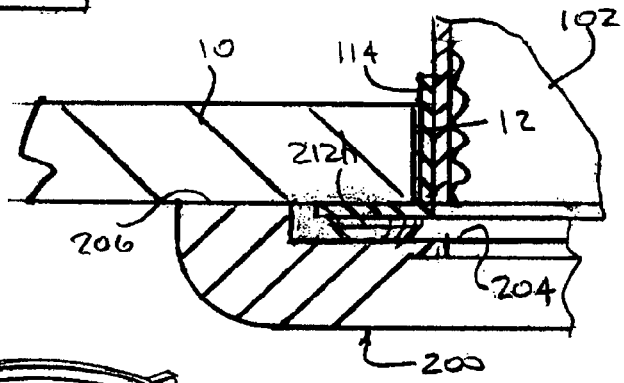

FIG. 4H illustrates suction members 212*h* engaging trim plate 114. Suction member 212*h*, e.g. suction cups, engage trim plate 114 using vacuum force. Other vacuum type engagement members can be used.

Figure 5:
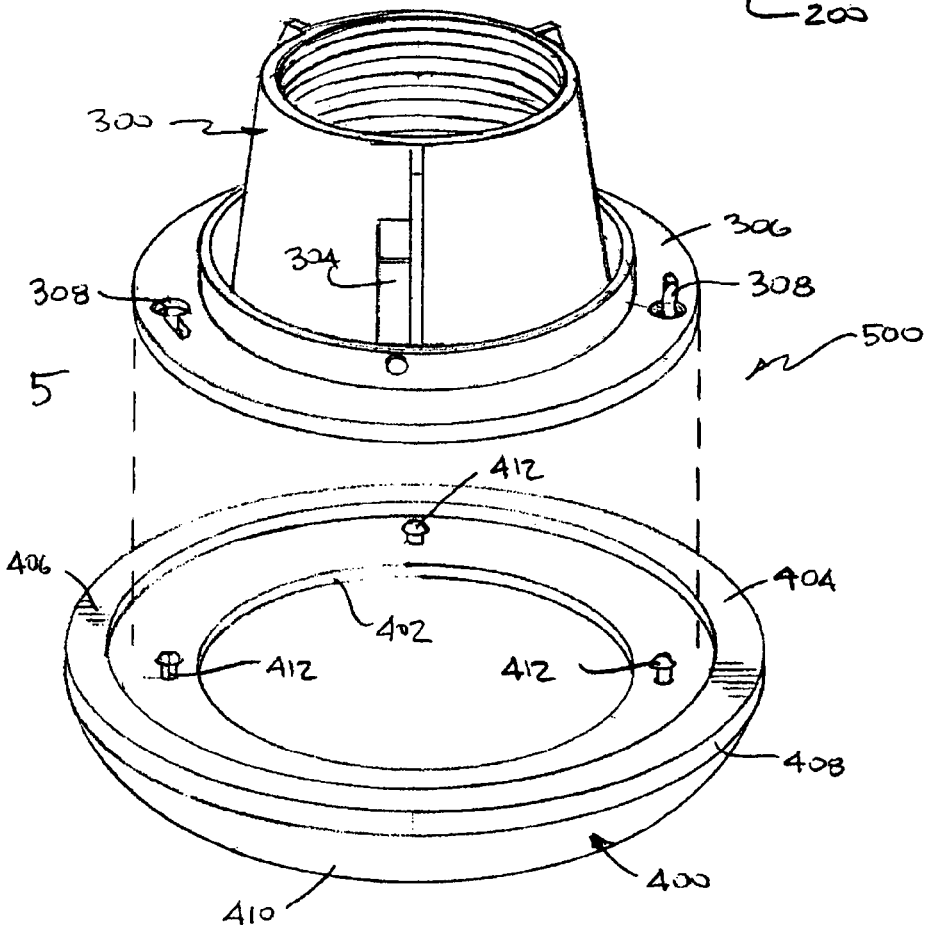
FIG. 5 is an exploded view of a trim insert, according to another embodiment, of the present invention.
Figure 6:
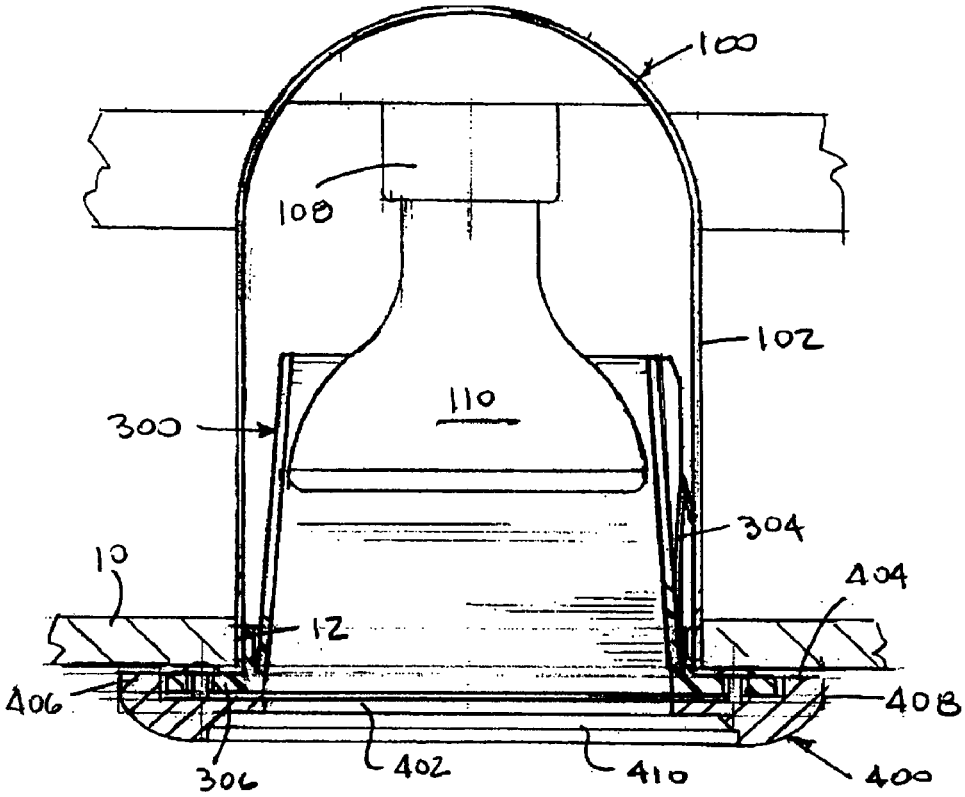
FIG. 6 is a cross sectional view of the trim insert mounted to a recessed light of the embodiment of FIG. 5.

Referring now to FIGS. 5 and 6, a universal trim insert 500 for recessed light 100 is illustrated. Universal trim insert 500 is designed to be used with any recessed light 100 and includes a baffle 300 and a trim piece 400. Baffle 300 is sized to be disposed inside housing 100. Baffle 300 replaces prior art baffle 112 and is inserted into housing 102 through open side 104. A baffle engagement member 304 can be disposed on baffle 300 and removably engages housing 102 to fix baffle 300 in housing 102. One or more baffle engagement members 304 can be used. In the preferred embodiment, baffle engagement member 304 is a leaf spring formed from spring steel and frictionally engages a side of housing 102. Other baffle engagement member 304 can be similar to universal engagement member 212 and can include leaf tabs, magnets, adhesives, fasteners, compression members, spring-loaded members, threaded members, and suction members. Baffle engagement member 304 allows universal trim insert 500 to retrofit onto any existing recessed lighting fixture 100, regardless of manufacturer. Housings, regardless of manufacture, are sold in a number of standard size ranges. Universal trim insert 500 is designed to fit a range of similar sized recessed lights and baffle engagement member 304 is disposed to engage a range of sizes of housings. Baffle engagement member 304 removably engages housing 102, allowing a user to change or remove universal trim insert 500 with minimal effort.

An interface member 306 can be disposed on an end of baffle 300 and can be located outside ceiling 10. Interface member 306 can be in contact with ceiling 10 when baffle 300 is engaged in housing 100 or can be set inside baffle 300 (not illustrated). In an embodiment, a universal trim piece 400 engages interface member 306 and the engagement is described below. In another embodiment, a trim engagement member 308 is disposed on the interface member 306 and interacts with an engagement member 412 to removably engage and secure universal trim piece 400 to interface member 306. This interaction will be described below in regards to universal engagement member 412.

Trim piece 400 has an aperture 402 sized to approximately conform to a size of open side 104 of housing 102. Trim piece 400 can be manufactured out of any of the materials described above in the previous embodiment.

A mounting side 404 is disposed toward ceiling 10. In a preferred embodiment, trim piece 400 further includes an upstanding lip 406 disposed on a perimeter 408 of mounting side 404. Lip 406 allows for a gap between ceiling 10 and mounting side 404 and lip 406 can contact ceiling 10. A further embodiment places universal engagement member 412 on lip 406.

Decorative side 410 is disposed opposite mounting side 404 and can have the same properties and designs as decorative side 210.

Universal engagement member 412 can be disposed on mounting side 404 to removably engage interface member 306 and secure trim piece 400 to the interface member 306. One or more universal engagement members 412 allow trim piece 400 to retrofit onto any existing recessed lighting fixture 100, regardless of manufacturer, through the engagement of baffle 300. Housings, regardless of manufacturer, are sold in a number of standard size ranges. Universal trim housing 500 is designed to fit a range of similar sized recessed lights. This allows a user to change or remove universal trim insert 400 with minimal effort and does not require housing 102 to be removed from ceiling 10 and replaced. In a preferred embodiment, universal engagement member 412 only engages interface member 306 and does not engage housing 102. Universal engagement member 412 can be similar to universal engagement member 212 and can include leaf tabs, magnets, adhesives, fasteners, compression members, spring-loaded members, threaded members, and suction members as described above.

A further embodiment, illustrated in FIG. 5, trim engagement member 308 and universal engagement member 412 can interact with each other to secure trim piece 400. Embodiments include a bayonet lock, tab and slot, opposing magnets, screw and nut and friction fit between the two elements. Thus, universal engagement member 412 is disposed on trim piece 400 and its mate, trim engagement member 308, is disposed on interface member and the two interact to secure trim piece 400 to baffle 300.

Figure 7:
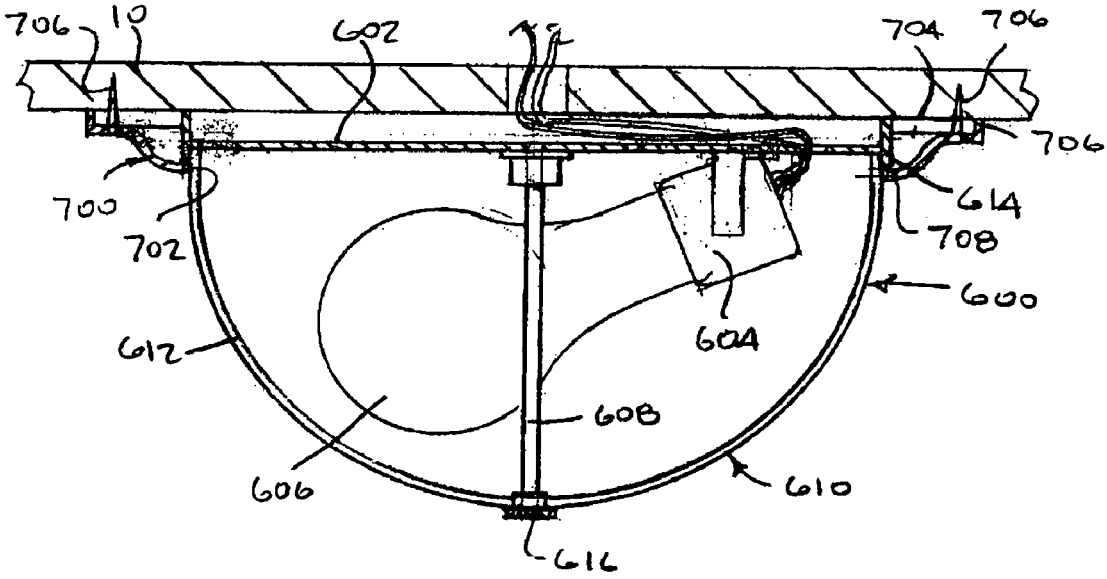
FIG. 7 is a perspective view of an embodiment of the universal trim piece mounted to a flush mounted fixture.

FIG. 7 illustrates an embodiment of the invention mounted to flush mounted fixture 600. A typical flush mounted fixture 600 includes a base plate 602 mounted to ceiling 10. Base plate 602 has at least one lamp socket 604 connected to a power supply (not illustrated) mounted opposite ceiling 10. A lamp 606 engages lamp socket 604 and lamp socket 604 provides power for lamp 606. Mounted to base plate 602 is a stem 608 and depends downward toward the floor (not illustrated). Covering base plate 602 is a fixture cover 610 including a dome 612 that covers the majority of the base plate 602 and is dome shaped. A trim ring 614 is engaged, either fixedly or removedly, to dome 612. Dome 612 has a mount 616 that removable engages stem 608. Mount 616 is typically threaded and engages matching threads on stem 608 or mount 616 is a screw and engages threads inside stem 608.

Turning to the present invention, a universal trim piece 700 is designed to, in one embodiment, cover trim ring 614. Further, universal trim piece 700 has an aperture 702 sized to receive dome 612 and can be larger. As illustrated, aperture 702 generally conforms to a circular shape of dome 612. However, in an embodiment, both universal trim piece 700 and aperture 702 can be any shape, including circular, elliptical, oval, triangular, rectangular, or any curved or polygonal shape that will accept dome 612. Further, both universal trim piece 700 and aperture 702 can be similarly shaped, e.g. both circular, or can have different shapes, e.g. universal trim piece 700 is rectangular and aperture 702 is circular. Universal trim piece 700 can be manufactured out of any material known in the art, including the exemplary materials for universal trim piece 200, described above, and have any finish.

A mounting side 704 is disposed toward ceiling 10 and typically contacts ceiling 10. Universal trim piece 700 can further include an upstanding lip 706 that allows for a gap between trim ring 614 and universal trim piece 700. When lip 706 is included, it preferably contacts ceiling 10. Further embodiments may variably contact ceiling 10 due to the visual style of universal trim piece 700 or as a consequence of the process that forms universal trim piece 700, e.g. stamping and casting.

Universal trim piece 700 has a decorative side 708 which is viewable when one looks up at ceiling 10. In the preferred embodiment, decorative side 708 is milled with a pattern, shape and/or texture to provide an aesthetic look once universal trim piece 700 is mounted over trim ring 614. Decorative patterns can be similar to the patterns for universal trim piece 200.

A universal engagement member 708 can be disposed on mounting side 704 to removably engage trim ring 614. One or more universal engagement members 708 allow universal trim piece 700 to retrofit onto any existing flush mounted fixture cover 610, regardless of manufacturer. Flush mounted fixture 600, regardless of manufacturer, is sold in a number of standard size and shape ranges. Universal trim piece 700 is designed to fit a range of similar flush mounted fixtures 600 and universal engagement member 708 is disposed to engage a range of trim rings 614 in various shapes and sizes.

Numerous types of universal engagement member 708 are contemplated. Universal engagement member 708 can be similar to universal engagement member 212 and can include leaf tabs, magnets, adhesives, fasteners, compression members, spring-loaded members, threaded members, and suction members as described above.

Figure 8A:
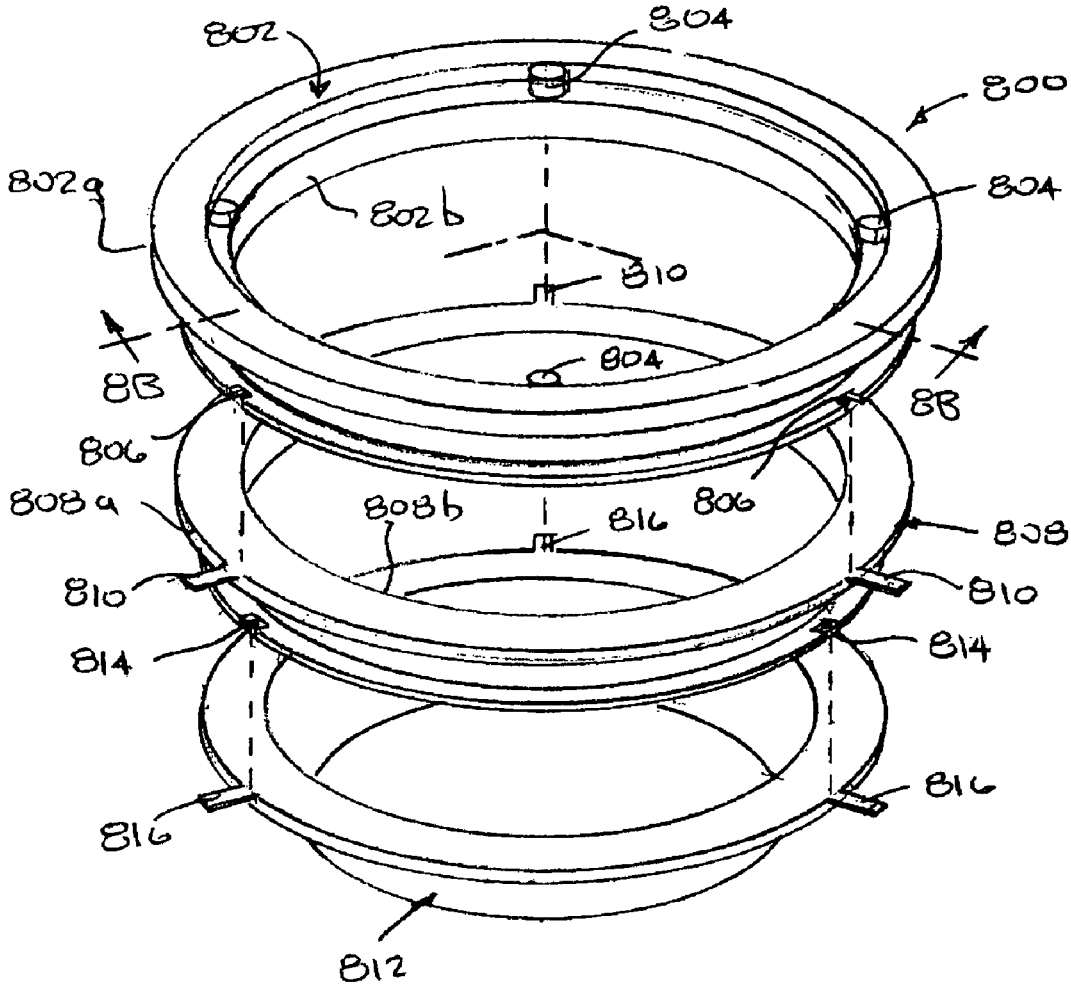
FIG. 8A is an exploded view of an embodiment of the universal trim piece of the present invention.
Figure 8B:
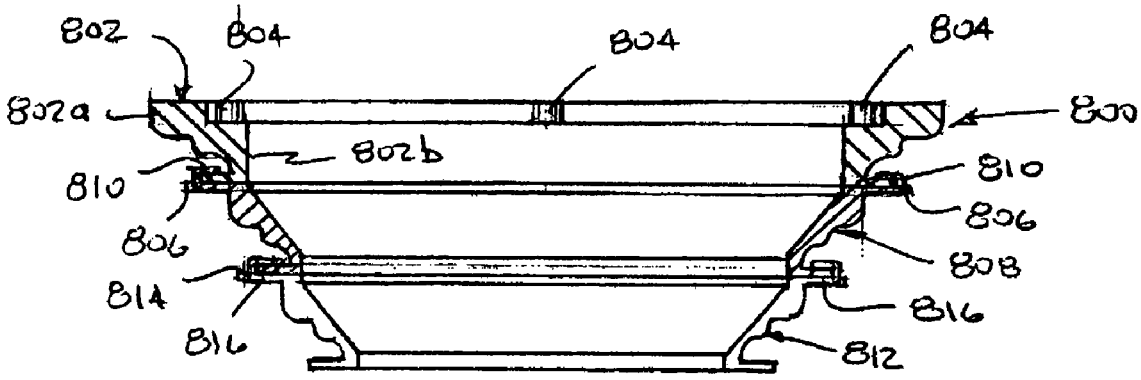
FIG. 8B is a cross-sectional view of the embodiment in FIG. 8A.

FIGS. 8A and 8B illustrate an embodiment of universal trim piece 200, 400, 700 wherein the universal trim piece 800 is made of two or more different sections. FIGS. 8A and 8B illustrate a three section embodiment. A trim engagement section 802 is disposed closest to ceiling 10 and typically a universal engagement member 804 is disposed on this section. Universal engagement member 804 can be similar to universal engagement member 212 and can include leaf tabs, magnets, adhesives, fasteners, compression members, spring-loaded members, threaded members, and suction members as described above.

Trim engagement section 802 can be manufactured out of any material known in the art, including the exemplary materials for universal trim piece 200, described above, and have any finish. Trim engagement section 802 is typically circular and has an outside diameter 802*a* and an inside diameter 802*b*. However, in an embodiment, trim engagement section 802 can be any shape, including circular, elliptical, oval, triangular, rectangular, or any curved or polygonal shape.

Second section 808 is disposed below trim engagement section 802. A first section engagement member 806 is disposed opposite the ceiling side of trim engagement section 802 and engages a second section engagement member 810 disposed on second section 808. First section engagement member 806 and second section engagement member 810 are corresponding opposites and can be similar to universal engagement member 212 and can include leaf tabs, magnets, adhesives, fasteners, compression members, spring-loaded members, threaded members, and suction members as described above. For example, first section engagement member 806 can be lip 812*a* that engages a similarly shaped shelf or groove 812*b* disposed on second section 808.

Second section 808 is typically circular and has an outside diameter 808*a* and an inside diameter 808*b*. However, in an embodiment, second section 808 can be any shape, including circular, elliptical, oval, triangular, rectangular, or any curved or polygonal shape. The materials, finishes, shapes, sizes, inside diameters 802*a*, 808*a* and outside diameters 802*b*, 808*b* of trim engagement section 802 and second section 808 can be similar or different. This allows a user to mix and match all aspects of the design of universal trim ring 800 while minimizing the cost to manufacture because sections 802 and 808 can be manufactured and mixed and matched to make a custom look to universal trim piece 800.

A third section 812 can also be included in universal trim piece 800. To accommodate third section 812, second section 808 includes a third section engagement member 814 engaging a fourth section engagement member 816 disposed on third section 812. As with first and second section engagement members 802, 810, third and fourth section engagement members 814, 816 can be any fastener described above and any fastener contemplated by one of skill in the art.

Further, third section 812 can be manufactured out of any material known in the art, including the exemplary materials for universal trim piece 200, described above, and have any finish. Third section 812 is typically circular but can be any shape, including circular, elliptical, oval, triangular, rectangular, or any curved or polygonal shape. The materials, finishes, shapes, sizes, and diameters of trim engagement section 802 and second section 808 and third section 812 can be similar or different.

FIG. 9 illustrates another embodiment of a universal trim piece 900. Universal trim piece 900 incorporates features of both universal trim piece 200 and 800. Universal trim piece 900 is designed to engage trim ring 114 of recessed light 100. However, instead of aperture 202, lens or dome 902 can be placed in the opening to retro-fit recessed light 100 to look like a flush mounted fixture 600. Universal trim piece 900 includes all the features and range of options of the other universal trim pieces 200, 400.

FIG. 10 illustrates a similar embodiment for universal trim piece 900, wherein universal trim piece 900 includes a trim engagement section 904, a second section 906 and a third section 908. All three sections 904, 906, 908 can be different in all aspects, including, e.g. sizes, shapes, and materials. FIG. 10 illustrates third section 908 as a lens or dome. This is another example of retrofitting recessed light 100 to appear as flush mounted fixture 600.

Referring to FIGS. 11*a*-11*c*, cross sections of another embodiment of a universal trim piece 1100 are illustrated. Universal trim piece 1100 has a universal engagement member 1102 to engage trim ring 114 of recessed light 100. Universal engagement member 1102 can be similar to universal engagement member 212 and can include leaf tabs, magnets, adhesives, fasteners, compression members, spring-loaded members, threaded members, and suction members as described above. Universal trim piece 1100 also includes diffuser section 1104 to fully or partially obscure open side 104 of recessed light 100. Diffuser section 1104 can be made of a translucent material to diffuse light emitted from lamp 100. Alternately, diffuser section 1104 can be made from an opaque material and slits 1106 can allow light to pass. Slits 1106 can be cut into diffuser section to form a pattern or can be placed at random. Further, a transparent or translucent material 1108 can be disposed in slits 1106 to form a diffused light pattern through slits 1106 or translucent material 1108 can be colored to produce different lighting effects. Universal trim piece 1100 is illustrated dome shaped but can be formed in any two or three dimensional shape.

FIG. 12 shows a further embodiment of a universal trim piece 1200, which is similar to universal trim piece 1100 but extends a significant amount below recessed light 100 and ceiling 10. Universal trim piece 1200 has a universal engagement member 1202 to engage trim ring 114 of recessed light 100. Universal engagement member 1202 can be similar to universal engagement member 212 and can include leaf tabs, magnets, adhesives, fasteners, compression members, spring-loaded members, threaded members, and suction members as described above.

Universal trim piece 1200 also includes diffuser section 1204 to fully or partially obscure open side 104 of recessed light 100. Diffuser section 1204 can extend past the ceiling and mimic a different type of fixture. FIG. 12 illustrates diffuser section 1204 having a ceiling section 1206 which lays flush with ceiling 10 when universal trim piece 1200 is mounted to trim 114. Ceiling section 1206 has an aperture 1208 to allow light to enter diffuser section 1204. Aperture 1208 can be shaped to allow trim piece 114 to pass and have universal engagement member 1202 mounted inside diffuser section 1204. Alternately, aperture 1208 can be shaped to allow all or most of the light emitted thorough open side 104 of recessed light 100 but prevent trim ring 114 from entering diffuser section 1204 and universal engagement member 1202 is mounted on a ceiling side of ceiling section 1204.

Depending from ceiling section 1204 are two or more side walls 1210. Side walls 1210 can be transparent, translucent, or opaque and do not have to be equally sized. Further, side walls 1210 can contain openings 1212. Openings 1212 can be cut into side walls 1210 to form a pattern or can be placed at random. Further, a transparent or translucent material 1214 can be disposed in openings 1212 to form a diffused light pattern or translucent material 1214 can be colored to produce different lighting effects.

Alternately, a bottom wall 1216 can be disposed to fully or partially enclose side walls 1210 and can be the same or a different shape than ceiling section 1206. Bottom wall 1216 can have openings 1212 similar to side walls 1210.

Diffuser section 1204 can include some or all of ceiling section 1206, side walls 1210 and bottom wall 1216. The combination of ceiling section 1206, side walls 1210 and bottom wall 1216 are used to form multiple three-dimensional designs. FIG. 12 illustrates a box or cube shape. Side walls 1210 can be sloped to form aperture 1208 and/or a point to replace bottom wall 1216. Ceiling section 1206, side walls 1210 and bottom wall 1216 can have a surface roughness or texture and can be arcuate, angled or straight.

While there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

I claim:

1. A retrofitted lighting fixture assembly comprising: a recessed lighting fixture having a housing mounted inside a ceiling and having an open side and a trim ring mounted to the open side of the housing and having an integral first and second portions, the first portion extending from inside the ceiling to outside the ceiling and having the second portion extending from the first portion and axially away from the housing and having a greater diameter than the housing and having a surface positioned adjacent an outer planar surface of the ceiling; a universal trim piece for retrofitting to the lighting fixture comprising: a mounting side disposed toward the ceiling and positioned over the trim ring and having an aperture sized to conform with a dimension of the open side of the housing; a decorative side disposed opposite the mounting side; and a universal engagement member, disposed on the mounting side, to removably engage a portion of the outer portion of the trim ring to retrofit the universal trim piece to the housing, the engagement member having a first set of circumferentially spaced bendable leaf tabs arranged to engage a small trim ring, a second set of circumferentially spaced bendable leaf tabs arranged to engage an intermediate-sized trim ring, and a third set of circumferentially spaced bendable leaf tabs for engaging a large trim ring.

2. The assembly of claim 1, wherein the mounting side of the universal trim piece contacts the ceiling.

3. The assembly of claim 1. further comprising an upstanding lip disposed on a perimeter of the mounting side of the universal trim piece, the lip being configured to contact the ceiling when in us.

4. The assembly of claim 1, wherein a shape of the aperture differing from a shape of the universal trim piece.

5. The assembly of claim 1, further comprising:

a diffuser section including:

a ceiling part engaging the universal trim piece to secure the diffuser section proximate to the ceiling and having an aperture to allow light to pass through; and at least one wall depending from the ceiling part wherein the wall is at least one of opaque, translucent and transparent.

6. The assembly of claim 5, wherein the diffuser section further comprises a bottom wall depending from the at least one wall and is at least one of opaque, translucent and transparent.

7. The assembly of claim 5, wherein the at least one wall is one of opaque and translucent and having at least one opening to allow light to pass through.

8. The assembly of claim 6, wherein the bottom wall is one of opaque and translucent and having at least one opening to allow light to pass through.

* * * * *